US011559132B2

(12) United States Patent
Ollinger et al.

(10) Patent No.: US 11,559,132 B2
(45) Date of Patent: Jan. 24, 2023

(54) HAT CARRYING APPARATUS AND METHOD

(71) Applicants: Stacey S. Ollinger, Atlanta, GA (US); Carley Faircloth, New York City, NY (US)

(72) Inventors: Stacey S. Ollinger, Atlanta, GA (US); Carley Faircloth, New York City, NY (US)

( * ) Notice: Subject to any disclaimer, the term of this patent is extended or adjusted under 35 U.S.C. 154(b) by 339 days.

(21) Appl. No.: 16/795,898

(22) Filed: Feb. 20, 2020

(65) Prior Publication Data

US 2020/0268135 A1 Aug. 27, 2020

Related U.S. Application Data

(60) Provisional application No. 62/808,475, filed on Feb. 21, 2019.

(51) Int. Cl.
*A45F 5/06* (2006.01)
*A45F 3/14* (2006.01)

(52) U.S. Cl.
CPC ..... *A45F 5/06* (2013.01); *A45F 3/14* (2013.01); *A45F 2003/142* (2013.01); *A45F 2200/05* (2013.01)

(58) Field of Classification Search
CPC ..... A45F 5/06; A45F 3/14; A45F 2003/142; A45F 2200/05
See application file for complete search history.

(56) References Cited

U.S. PATENT DOCUMENTS

| | | | | | |
|---|---|---|---|---|---|
| 1,490,066 | A * | 4/1924 | Carr | A45F 3/14 | 224/159 |
| 2,572,889 | A * | 10/1951 | Strykower | A45F 3/14 | 224/258 |
| 3,884,403 | A * | 5/1975 | Brewer | A45F 3/14 | 224/907 |
| 5,307,967 | A * | 5/1994 | Seals | A45F 3/14 | 224/616 |
| 5,890,638 | A * | 4/1999 | Woloshen | A45F 5/02 | 24/3.1 |
| 7,334,714 | B2 * | 2/2008 | Brown | A45C 13/30 | 224/625 |
| 9,943,162 | B1 * | 4/2018 | Samelian | A45F 4/02 | |
| 2002/0008125 | A1 * | 1/2002 | Caputi | A45C 13/30 | 224/264 |
| 2005/0184117 | A1 * | 8/2005 | Brown | A45C 13/30 | 224/623 |
| 2018/0310696 | A1 * | 11/2018 | Getter | A44B 11/06 | |

* cited by examiner

*Primary Examiner* — Robert Sandy
*Assistant Examiner* — Louis A Mercado
(74) *Attorney, Agent, or Firm* — Thomas I Horstemeyer, LLP

(57) ABSTRACT

Embodiments of an apparatus for carrying a hat are disclosed. The apparatus has an elongated strap having a length extending between first and second ends. A belt buckle and belt buckle holes are provided in the strap to enable adjustment of the strap length. A first plurality of interlinked rings connects the first end of the strap to a first finger lever on a clip, and a second plurality of interlinked rings connects the second end of the strap to a second finger lever of the clip. The interlinked rings enable at least partial rotation of each end relative to the clip. The clip is used to attach to and carry a hat.

19 Claims, 5 Drawing Sheets

HAT CARRYING APPARATUS AND METHOD

CLAIM OF PRIORITY

This utility patent application claims the benefit of and priority to provisional application No. 62/808,475, filed on Feb. 21, 2019, which is incorporated by reference herein in its entirety.

FIELD OF THE INVENTION

The present disclosure provides various embodiments of an apparatus and method for carrying one or more hats.

BACKGROUND OF THE INVENTION

The wearing of hats, especially by the female segment of the population, has been popular for many years. This popularity has led to a wide variety of hats being available in numerous sizes and configurations which are primarily dictated by style preferences. In addition to being dictated by style, certain hat designs are created from the standpoint of functionality to the extent that certain hats are specifically designed to accomplish purposes such as warmth, protection from the sun, etc. Men's hats are also available in a wide variety of designs, but typically, are not as important in terms of making a fashion statement. Thus, men's hats are usually more visible in that they are often more casual, as evidenced by baseball caps, cowboy hats, and other sporting apparel.

One disadvantage associated with the design of various hat structures, regardless of whether they are intended for men or women, is the storage of the hat without folding or otherwise damaging it. For example, with respect to many fashionable hats, including some cowboy hats, storage often requires the use of relatively large, bulky "hat boxes" or other storage facilities which take up a great deal of room. Quite logically, it is difficult to transport hats stored in this manner. Consequently, the carrying of a hat, when it is not being worn, is generally considered to be somewhat bothersome, particularly with hats of larger sizes and/or of configurations designed to shade a wearer from the rays of the sun.

SUMMARY OF THE INVENTION

Embodiments of an apparatus and method for carrying a hat(s) are disclosed.

One embodiment of such an apparatus, among others, has an elongated strap having a length extending between first and second ends. An adjustment means, such as a belt buckle and belt buckle holes, are provided in the strap to enable adjustment of the strap length. A first plurality of interlinked rings connects the first end of the strap to a first finger lever on a clip, and a second plurality of interlinked rings connects the second end of the strap to a second finger lever of the clip. The interlinked rings enable at least partial rotation, or swiveling, of each end relative to the clip. The clip is used to attach to and carry one or more hats.

Other embodiments, apparatus, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
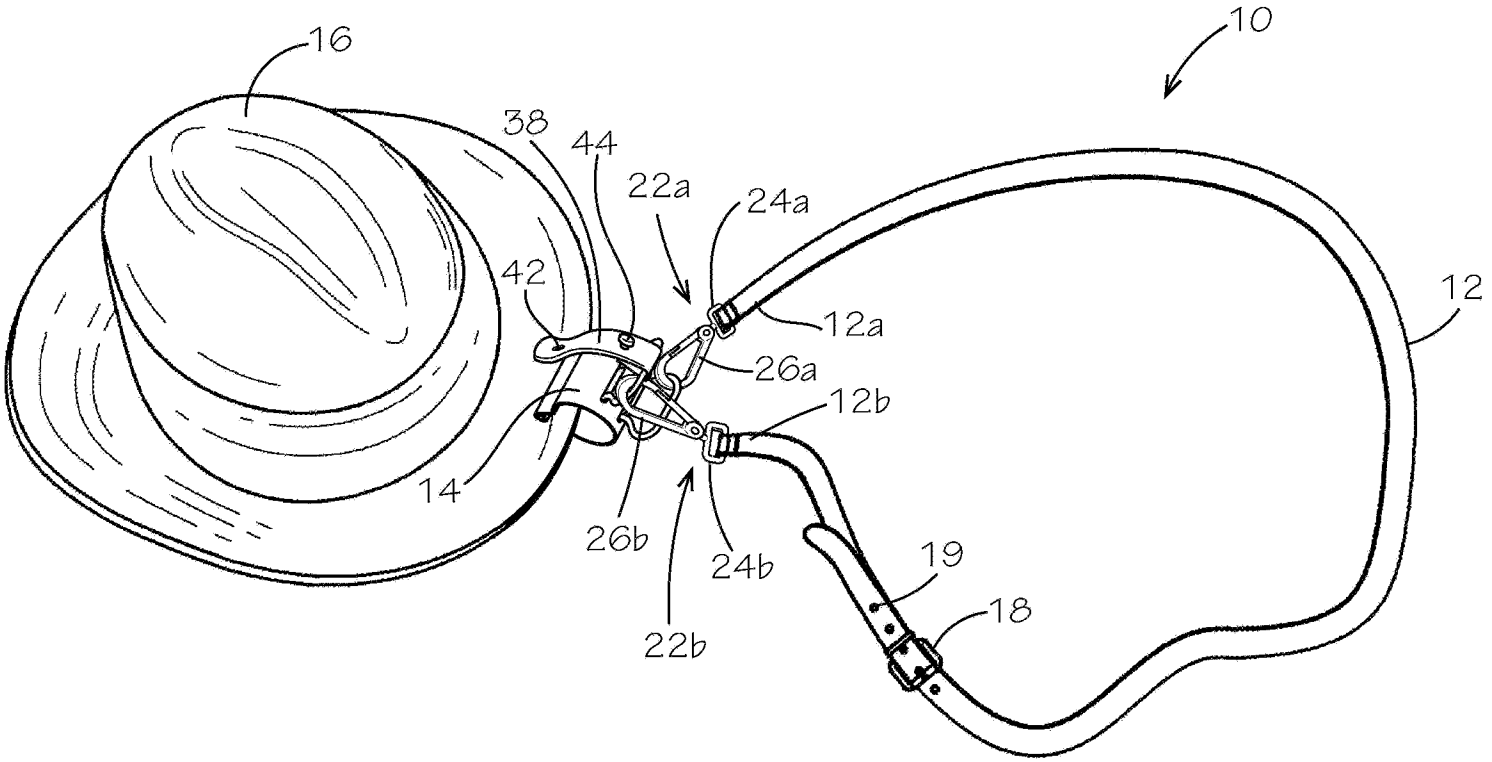
FIG. 1 is a perspective view of an example of a hat carrying apparatus in accordance with the present disclosure.

A nonlimiting example of a hat carrying apparatus 10 of the invention is shown in FIG. 1 through FIG. 5. This embodiment has an elongated flexible strap 12 with a suitable clip 14 for carrying a hat(s) 16. The strap 12 can be worn several ways, including but not limited to, cross body (FIG. 2), as a wristlet (FIG. 3), as well as coiled up and hidden in a person's purse 17 (FIG. 4) using only the clip 14 to hold the hat(s) 16 in place.

The strap 12 can take many different forms, but in this embodiment, it is a leather strap 12 with a small belt buckle 18 to enable the strap loop to be adjusted along belt buckle holes 19 in the strap 12. In alternative embodiments, the belt buckle 18 could be replaced with, for example, a hook and loop arrangement (e.g., Velcro), one or more buttons, one or more snap attachments, etc. In alternative embodiments, the strap 12 can be replaced with a chain, cord, wire, necklace, etc.

Each end 12*a*, 12*b* of the strap 12 is attached to a plurality of interlinked rings to enable swiveling motion at each end 12*a*, 12*b*. More specifically, each end 12*a*, 12*b* of the strap 12 has a respective swivel mechanism 22*a*, 22*b* comprising a respective first ring 24*a*, 24*b* that is attached to the respective end 12*a*, 12*b* of the strap 12 and a respective second ring 26*a*, 26*b* attached to the respective first ring 24*a*, 24*b* and at least partially rotatable with respect to the respective first ring 24*a*, 24*b*. The second rings 26*a*, 26*b* are attached to the clip 14. In this embodiment, the second rings 26*a*, 26*b* are carabiners to enable easy attachment to and detachment from the respective finger levers 34*a*, 34*b* associated with the clip 14. In alternative embodiments, two clips 14 may be provided, one for attaching each of the second rings 26*a*, 26*b* to the hat 16. In other alternative embodiments, both of the second rings 26*a*, 26*b* are attached to a single one of the finger levers 34*a*, 34*b*.

Figure 2:
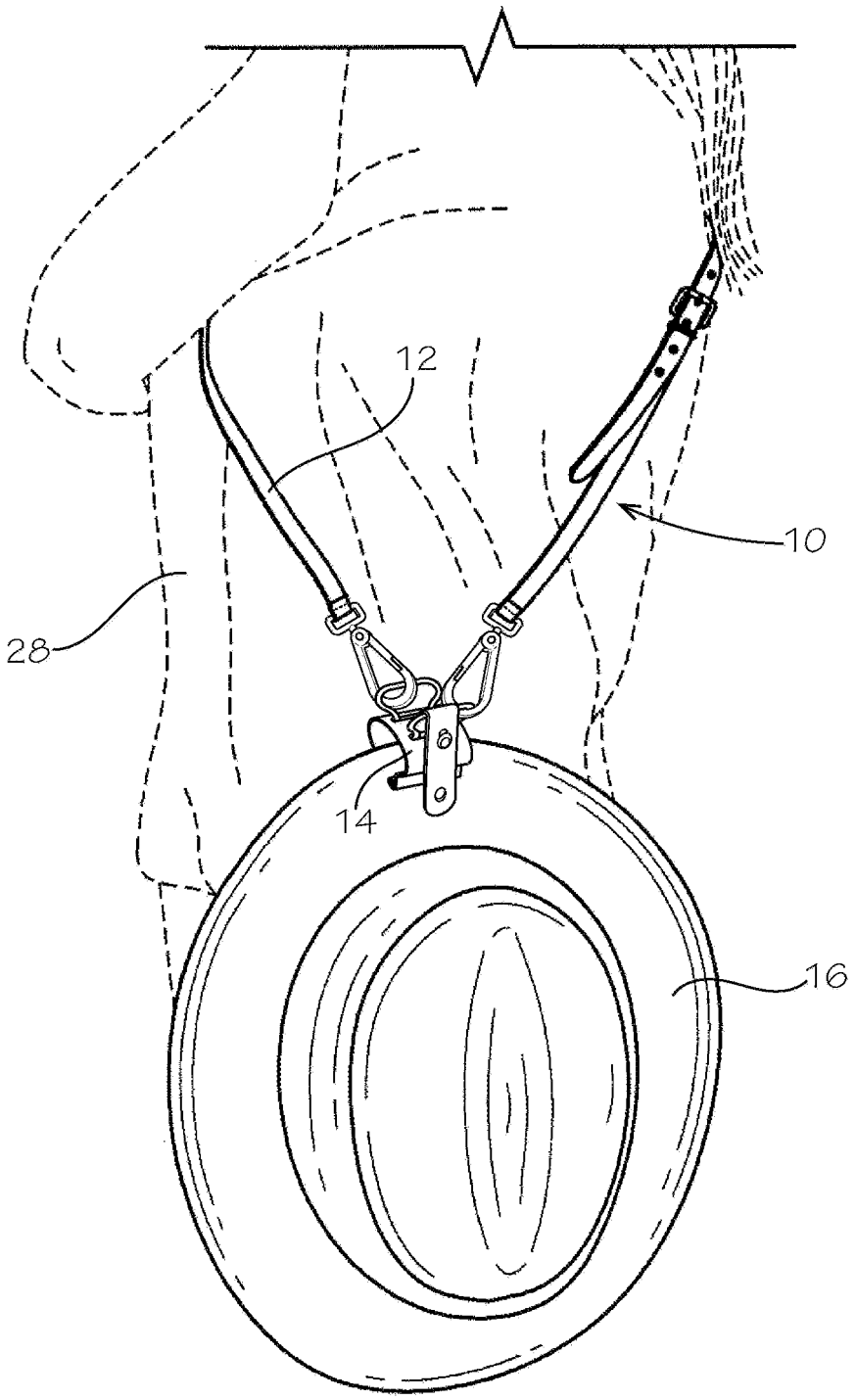
FIG. 2 is a perspective view of the hat carrying apparatus of FIG. 1 being worn cross body by a person with a strap wrapped over a shoulder of the person.
Figure 3:
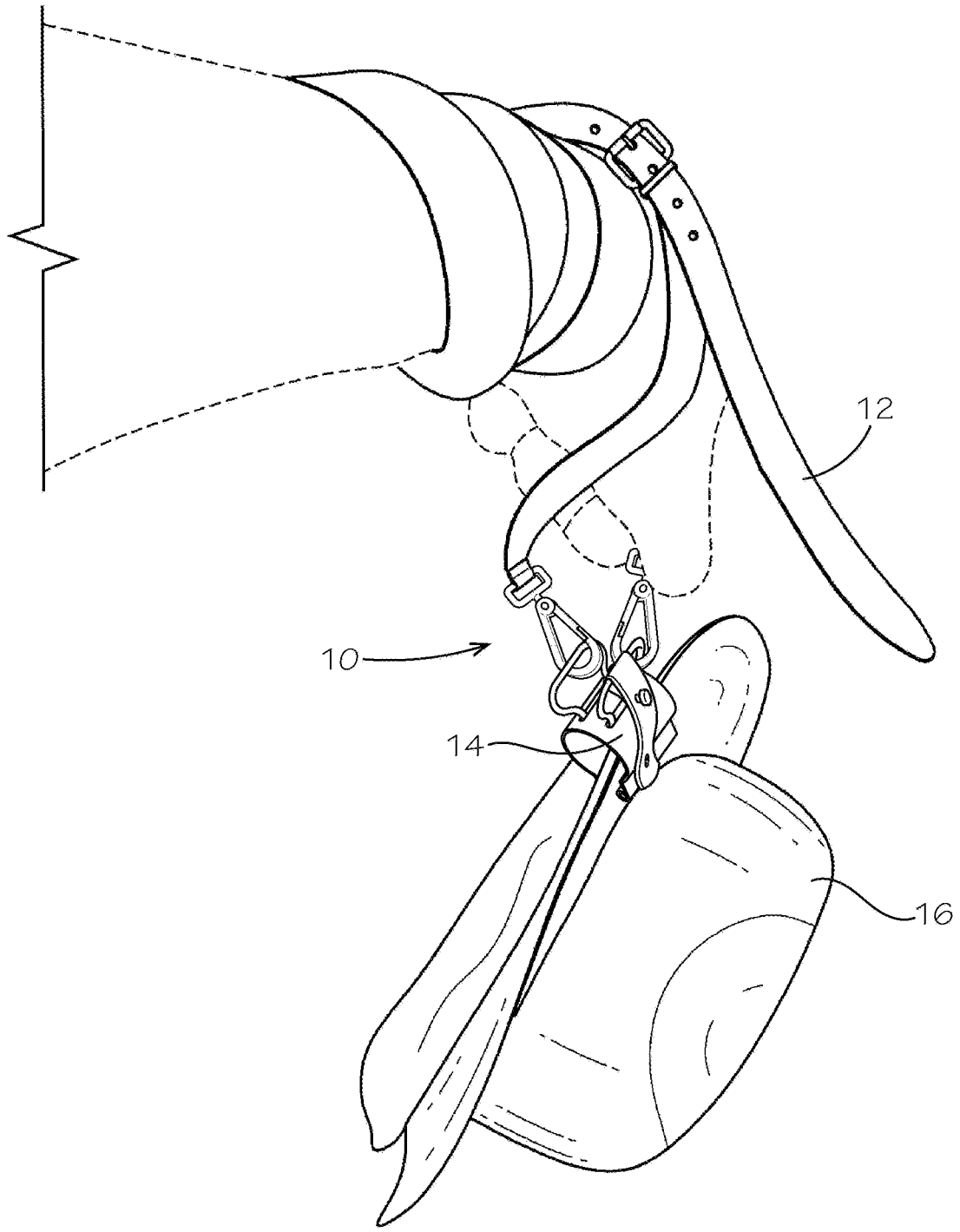
FIG. 3 is a perspective view of the hat carrying apparatus of FIG. 1 being worn by a person with the strap wrapped around the wrist of the person.
Figure 4:
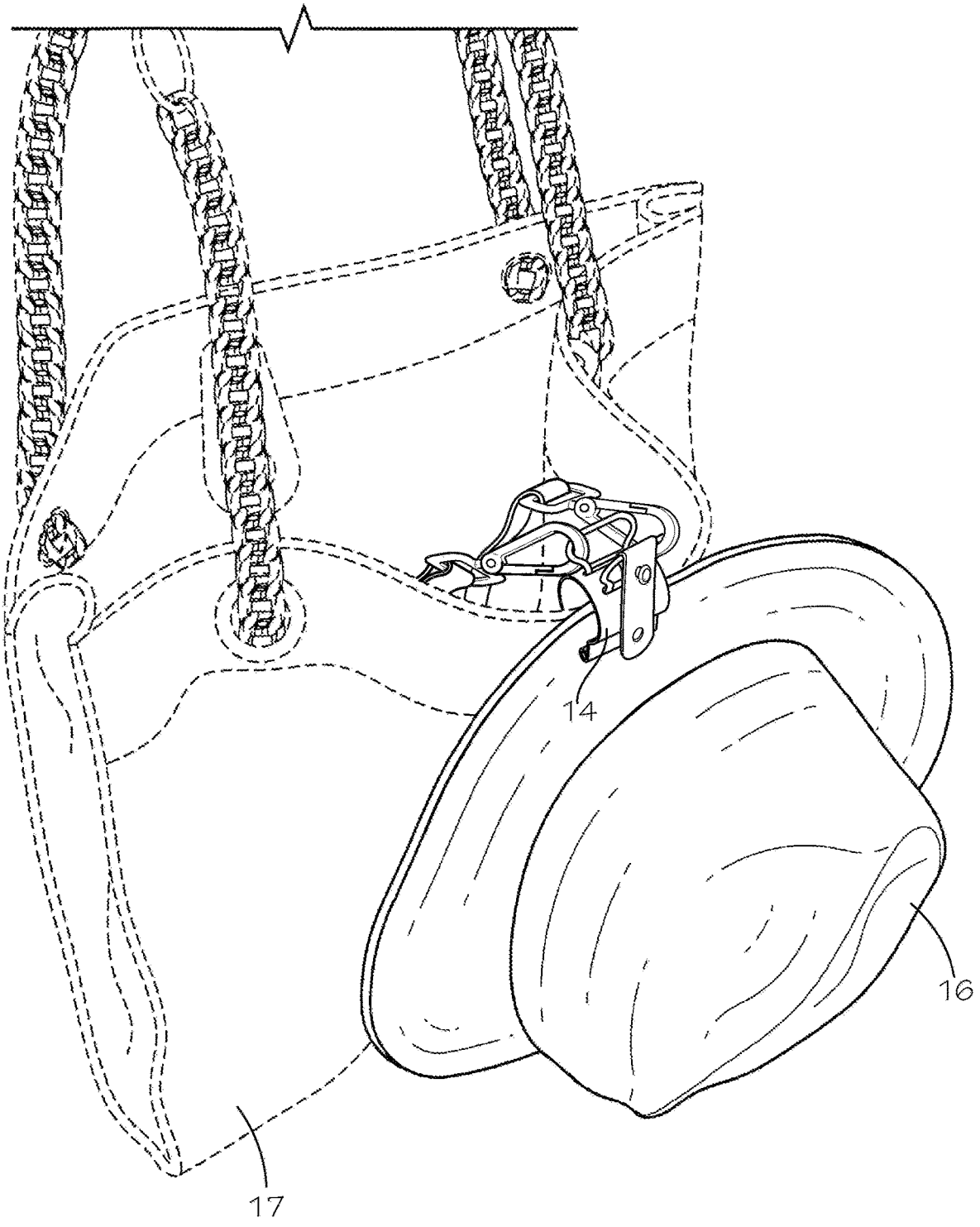
FIG. 4 is a perspective view of the hat carrying apparatus of FIG. 1 being attached to a bag carried by a person.

Other types of swivel mechanisms 22*a*, 22*b* are also possible and envisioned. The swivel mechanism 22 at each end 12*a*, 12*b* of the strap 12 enables the hat(s) 16 to lay against the body of a person 28, as shown in FIG. 2.

Figure 5:
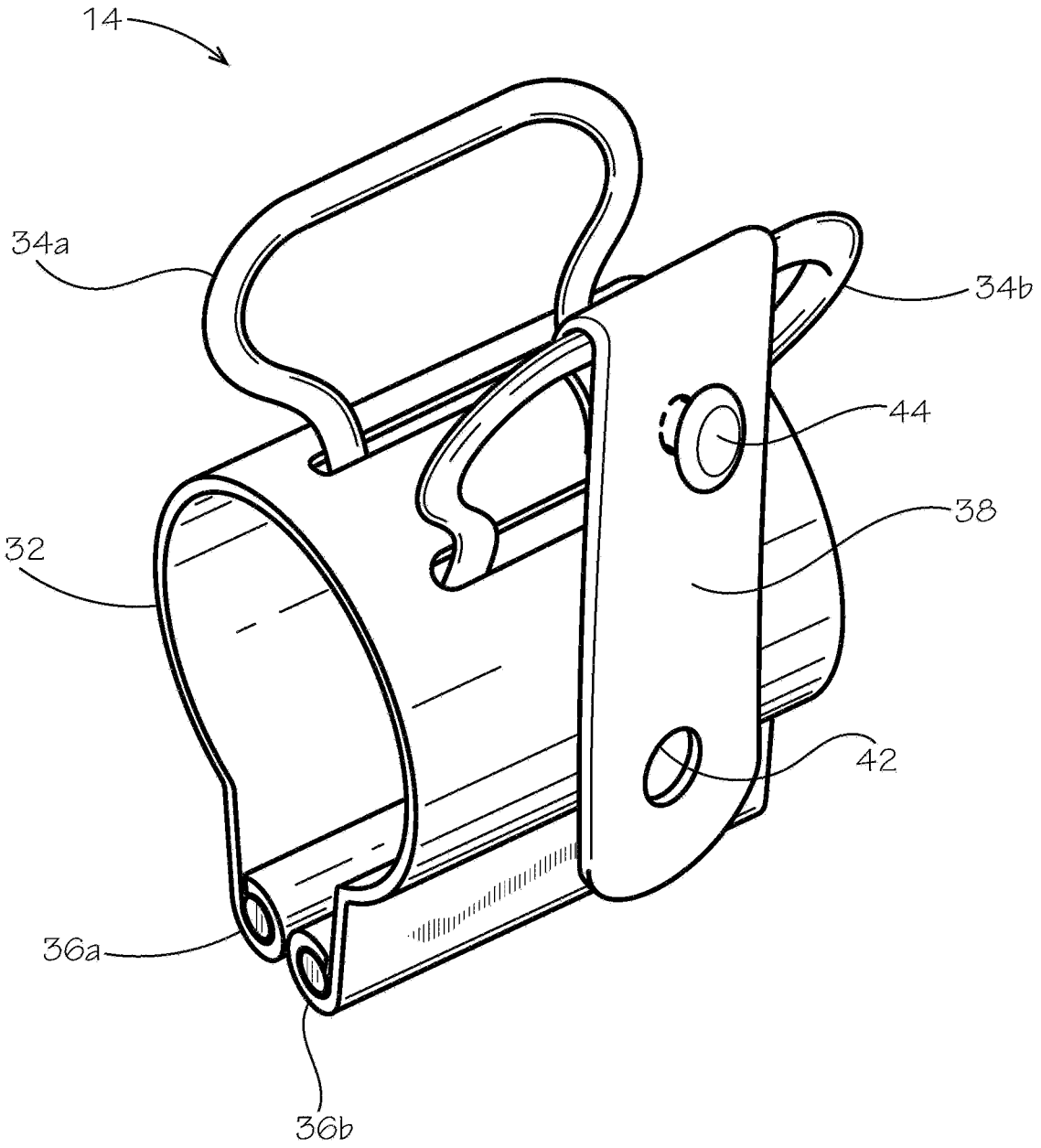
FIG. 5 is a perspective view of the binder clip utilized in the hat carrying apparatus of FIG. 1.

The clip 14 can take many different forms. In this embodiment, it is a type of metal binder clip, as shown in FIG. 5. This clip 14 has a generally cylindrical body 34 with finger levers 34*a*, 34*b* extending through the body 34 to respective clamping tips 36*a*, 36*b*, which extend downwardly from the body 34. The body 34 is sufficiently large enough in diameter to accommodate clamping of many different types of hats 16. Furthermore, the clamping tips 36*a*, 36*b* are continuously smooth along their lengths to prevent any possible damage to the hat 16. Other types of clips 14 are possible and envisioned.

As another optional feature, a flexible, preferably leather, tab 38 attached to and extending from one of the finger levers 34*a*, 34*b*. The tab 38 has a circular hole 42 and an upstanding cylindrical metal stud 44. The tab 38 can be wrapped around a part of a backpack, purse, bag, etc., in order to attach the hat carrying apparatus 10 to the part. In order to make the attachment, the tab 38 is wrapped around the part, the portion of the tab 38 having the hole 42 is moved to a position so that the hole is directly over the stud 44, and then the stud 44 is inserted into the hole 42.

The various parts of the hat carrying apparatus 10 can be any suitable color(s) and material(s).

While the preferred embodiment of the invention has been described, it will be apparent to those of ordinary skill in the art that many more embodiments and implementations are possible that are within the scope of this invention.

The invention claimed is:

1. An apparatus for carrying a hat, comprising:

an elongated length of flexible material having first and second ends;

adjustment means for enabling the length to be increased and decreased;

a clip means for attachment to and de-attachment from the hat, wherein the clip comprises first and second finger levers that are configured to open and close the clip;

swivel means attaching the first and second finger levers of the clip and the first and second ends of the elongated length of the flexible material, the swivel means enabling at least partial rotation of the clip relative to the ends.

2. The apparatus of claim 1, further comprising a hat attached to the clip means.

3. The apparatus of claim 1, wherein the length resides in a carry bag and wherein the clip binds the hat to a sidewall of the bag.

4. The apparatus of claim 1, wherein the swivels means comprises two swivel mechanisms, one at each of two ends of the elongated length, each of the swivel mechanisms designed to enable at least partial rotation of the respective end relative to the clip means.

5. The apparatus of claim 4, wherein each of the swivel mechanisms comprises at least first ring and second ring that are interlinked, the first ring attached to the respective end of the length and the second ring attached to the clip.

6. The apparatus of claim 5, wherein each of the second rings is a carabiner.

7. The apparatus of claim 1, wherein the clip means is a binder clip.

8. The apparatus of claim 1, wherein the flexible material is a strap and the adjustment means comprises a belt buckle and belt buckle holes in the strap.

9. The apparatus of claim 1, wherein the clip comprises:

a cylindrical body; and first and second clamping tips that extend downwardly from the body.

10. The apparatus of claim 1, wherein the clip comprises a tab that extends from the first finger lever or the second finger lever, the tab comprising a hole and a stud, the stub being configured to be inserted through the hole.

11. The apparatus of claim 10, wherein the tab comprises leather.

12. An apparatus for carrying a hat, comprising:

an elongated strap having first and second ends, the elongated strap having a belt buckle and belt buckle holes between the first and second ends to enable a length of the strap to be increased and decreased;

a clip for attachment to and de-attachment from the hat, wherein the clip comprises first and second finger levers that are configured to open and close the clip;

a first plurality of interlinked rings connecting the first end of the strap to the clip, wherein the first plurality of interlinked rings is attached to the first finger lever; and a second plurality of interlinked rings connecting the second end of the strap to the clip, wherein the second plurality of interlinked rings is attached to the second finger lever.

13. The apparatus of claim 12, wherein the clip comprises:

a body;

first and second clamping tips, the first and second finger levers extending through the body to the first and second clamping tips.

14. The apparatus of claim 12, further comprising a hat that is attached to the clip.

15. The apparatus of claim 12, wherein at least one of the first plurality of interlinked rings and at least one of the second plurality of interlinked rings is a carabiner.

16. An apparatus for carrying a hat, comprising:

an elongated strap having a length extending between first and second ends, the elongated strap having an adjustment means for enabling adjustment of the length;

a clip for attachment to and de-attachment from the hat, the clip comprising first and second finger levers designed to open and close the clip;

a first plurality of interlinked rings connecting the first end of the strap to the clip, the first plurality of interlinked rings attached to the first finger lever; and a second plurality of interlinked rings connecting the second end of the strap to the clip, the second plurality of interlinked rings attached to the second finger lever.

17. The apparatus of claim 16, wherein the adjustment means comprises a belt buckle and belt buckle holes.

18. The apparatus of claim 16, further comprising a hat attached to the clip.

19. The apparatus of claim 16, wherein at least one of the first plurality of interlinked rings and at least one of the second plurality of interlinked rings is a carabiner.

* * * * *